US009100740B2

(12) United States Patent
Huang

(10) Patent No.: US 9,100,740 B2
(45) Date of Patent: Aug. 4, 2015

(54) INNOVATIVE MAGNETIC DESIGN FOR SPEAKERS

(71) Applicant: Lai-Shi Huang, New Taipei (TW)

(72) Inventor: Lai-Shi Huang, New Taipei (TW)

( * ) Notice: Subject to any disclaimer, the term of this patent is extended or adjusted under 35 U.S.C. 154(b) by 41 days.

(21) Appl. No.: 13/906,770

(22) Filed: May 31, 2013

(65) Prior Publication Data

US 2014/0355815 A1 Dec. 4, 2014

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 25/00*** | (2006.01) |
| ***H04R 9/02*** | (2006.01) |
| ***H04R 9/04*** | (2006.01) |
| *H04R 19/02* | (2006.01) |
| *H04R 19/00* | (2006.01) |

(52) U.S. Cl.

CPC ..... *H04R 9/025* (2013.01); *H04R 9/027* (2013.01); *H04R 9/04* (2013.01); *H04R 9/045* (2013.01); *H04R 9/046* (2013.01); *H04R 19/00* (2013.01); *H04R 19/02* (2013.01)

(58) Field of Classification Search

CPC ..... H04R 9/04; H04R 9/041; H04R 9/045; H04R 9/046; H04R 9/025; H04R 9/027; H04R 19/00; H04R 19/02

USPC ..... 381/191, 407, 412, 420, 421, 422

See application file for complete search history.

(56) References Cited

U.S. PATENT DOCUMENTS

| | | | | |
|---|---|---|---|---|
| 8,553,926 | B2 * | 10/2013 | Takewa | 381/398 |
| 2004/0190747 | A1 * | 9/2004 | Chikama | 381/401 |
| 2006/0239499 | A1 * | 10/2006 | Stiles | 381/421 |
| 2007/0165902 | A1 * | 7/2007 | Matsumura et al. | 381/396 |

* cited by examiner

*Primary Examiner* — Matthew Eason
*Assistant Examiner* — Sean H Nguyen
(74) *Attorney, Agent, or Firm* — Muncy, Geissler, Olds & Lowe, P.C.

(57) ABSTRACT

An innovative magnetic design for speakers is disclosed. The innovative magnetic design of the present invention comprises an upper magnetic portion, a lower magnetic portion, at least one magnetic piece and two or more magnets. Either the upper magnetic portion or the lower magnetic portion has the form of a plate. A magnet is disposed between the upper magnetic portion and the magnetic piece, and another magnet is disposed between the lower magnetic portion and the magnetic piece. When an AC current flows through the voice coil, a magnetic force induced by the current would move the voice coil and diaphragm longitudinally, thereby generating audible sounds. In addition, we only have to increase the length of magnets 4 to increase their volume so as to increase the magnetic force and hence offset the decrease in the magnetic force due to a thinner configuration.

6 Claims, 6 Drawing Sheets

INNOVATIVE MAGNETIC DESIGN FOR SPEAKERS

BACKGROUND OF THE INVENTION

1. Field of the Invention

The invention generally relates to a magnetic design for speakers. More particularly, the invention relates to an innovative magnetic design through which we can increase the length of magnets to increase their volume so as to increase the magnetic force and hence offset the decrease in the magnetic force due to a thinner configuration.

2. Description of the Prior Art

In the prior art speakers, magnet and a voice coil are encased and affixed in a box. As an AC current flows through the voice coil, a magnetic force induced by the current would move the voice coil and a diaphragm longitudinally, thereby generating audible sounds. However, such structure is no longer sufficient because all electronic products are made thinner and more compact, which can reduce the induced magnetic force and hence adversely affect the performance of speakers.

SUMMARY OF THE INVENTION

The object of the present invention is to provide an innovative magnetic design through which we can increase the length of magnets to increase their volume so as to increase the magnetic force and hence offset the decrease in the magnetic force due to a thinner configuration.

To reach the object, the innovative magnetic design of the present invention is disclosed. The innovative magnetic design of the present invention comprises an upper magnetic portion, a lower magnetic portion, at least one magnetic piece and two or more magnets. Either the upper magnetic portion or the lower magnetic portion has the form of a plate. A magnet is disposed between the upper magnetic portion and the magnetic piece, and another magnet is disposed between the lower magnetic portion and the magnetic piece. The lower surface of the upper magnet, the upper surface of the lower magnet and the magnetic piece should be of the same polarity, and the upper surface of the upper magnet, the lower surface of the lower magnet, the upper magnetic portion and the lower magnetic portion should be of the opposite polarity.

LIST OF REFERENCE NUMERALS

| | |
|---|---|
| 1 Upper magnetic portion | 2 Lower magnetic portion |
| 3 Magnetic piece | 4 Magnets |
| 41 Ferrofluid | 5 Box |
| 6 Circular voice coil | 7 Affixing element |
| 8 Truncated cone-shaped basket | 81 Diaphragm |
| 82 Diaphragm | 83 Affixing point |
| 9 Folded structure | 10 Extended magnetic part(s) |

DETAILED DESCRIPTION OF THE PREFERRED EMBODIMENTS

Figure 1:
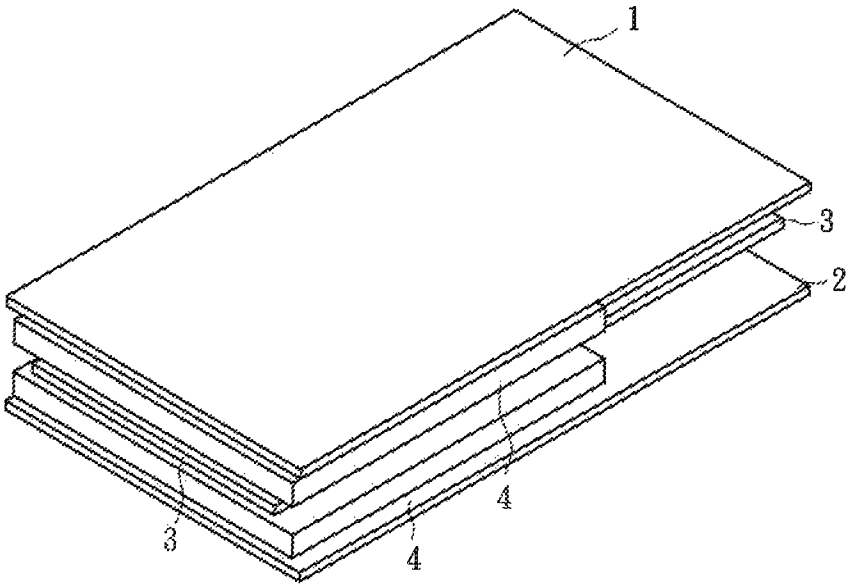
FIG. 1 is a perspective view showing the innovative magnetic design for speakers of the present invention.

Please refer to FIG. 1. The innovative magnetic design for speakers of the present invention comprises an upper magnetic portion 1, a lower magnetic portion 2, at least one magnetic piece 3 and two or more magnets 4. Either the upper magnetic portion 1 or the lower magnetic portion 2 has the form of a plate. The magnetic piece 3 has a certain thickness and is disposed between the upper magnetic portion 1 and the lower magnetic portion 2. A magnet 4 is disposed between the upper magnetic portion 1 and the magnetic piece 3 and another magnet 4 is disposed between the lower magnetic portion 2 and the magnetic piece 3. In addition, either the lower surface of an upper magnet 4 or the upper surface of a lower magnet 4 should have the same magnetic polarity as the magnetic piece 3; the upper surface of the upper magnet 4 should have the same magnetic polarity as the upper magnetic portion 1 and the lower surface of the lower magnet 4 should have the same magnetic polarity as the lower magnetic portion 2. For example, if the lower surface of the upper magnet 4, the upper surface of the lower magnet 4 and the magnetic piece 3 are of south pole, then the upper surface of the upper magnet 4, the lower surface of the lower magnet 4, the upper magnetic portion 1 and the lower magnetic portion 2 should be of north pole. Conversely, if the lower surface of the upper magnet 4, the upper surface of the lower magnet 4 and the magnetic piece 3 are of north pole, then the upper surface of the upper magnet 4, the lower surface of the lower magnet 4, the upper magnetic portion 1 and the lower magnetic portion 2 should be of south pole.

Figure 2:
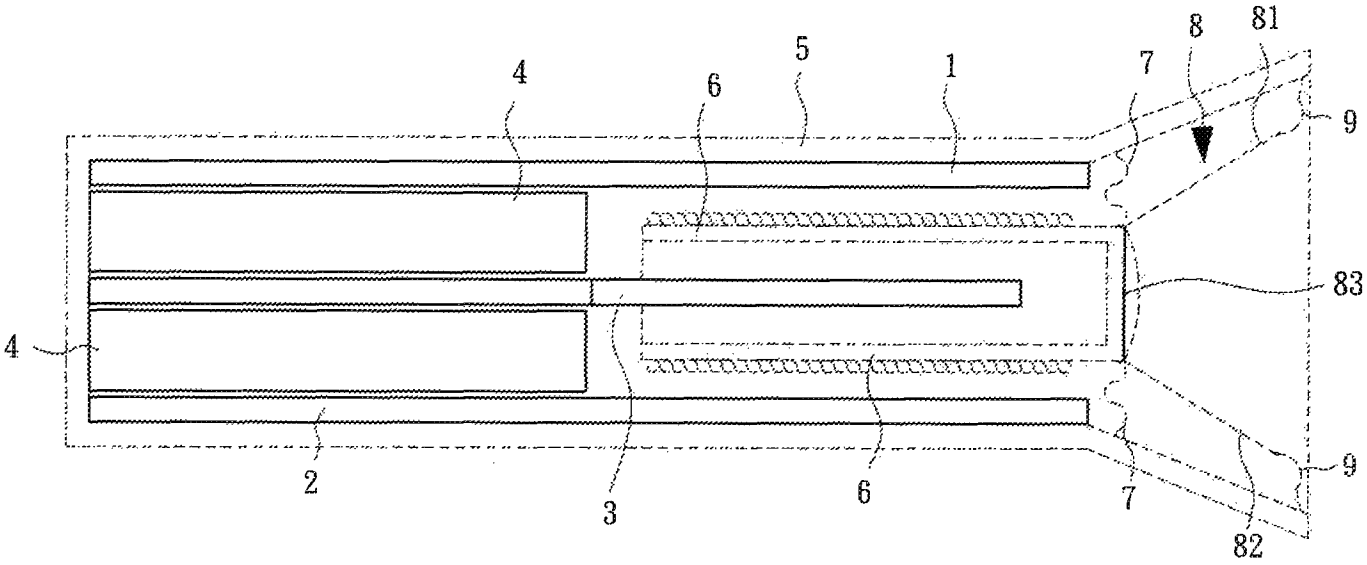
FIG. 2 is a side view illustrating the first embodiment of the present invention.
Figure 3:
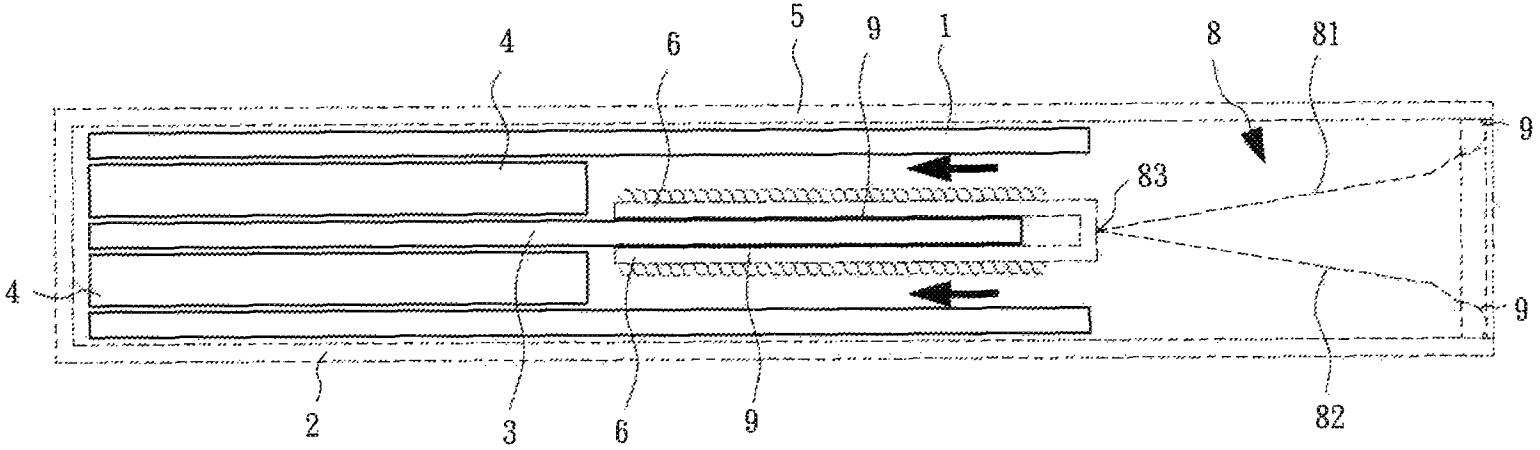
FIG. 3 is a side view illustrating the longitudinal movement of the voice coil and the diaphragm in the second embodiment of the present invention.
Figure 4:
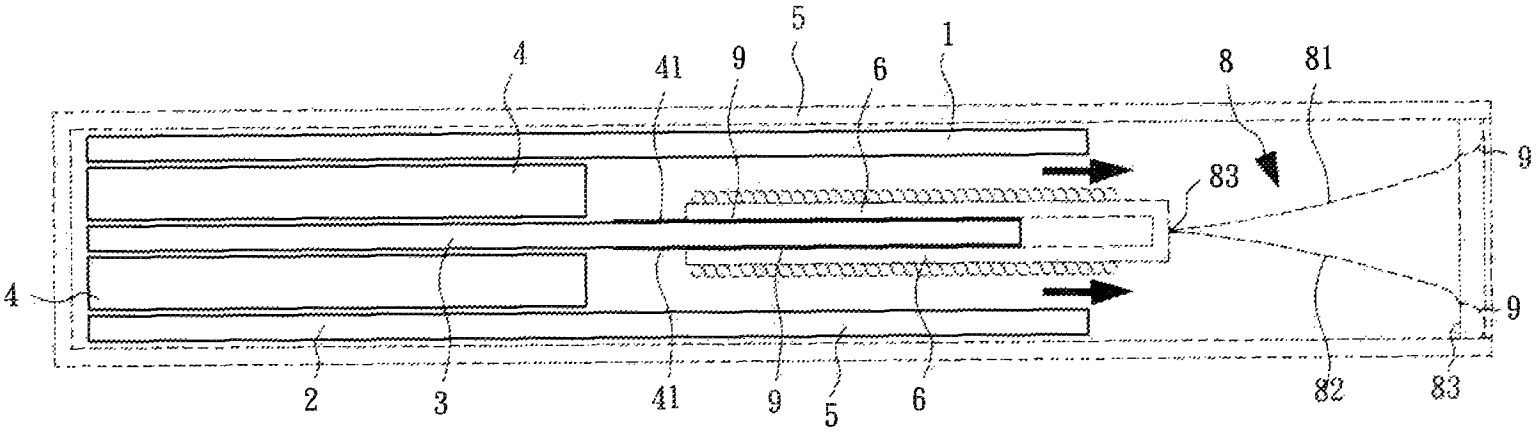
FIG. 4 is another side view illustrating the longitudinal movement of the voice coil and the diaphragm in the second embodiment of the present invention.

Please see FIGS. 2, 3 and 4, which illustrate the aforesaid components encased in a box 5. In the previously described polarity arrangement, a repulsive force exists between the upper magnetic portion 1, the upper magnet 4, the magnetic piece 3, the lower magnet 4 and the lower magnetic portion 2. In the present invention, glue, non-magnetized rivets or non-magnetic frames may be used to affix the upper magnetic portion 1, the upper magnet 4, the magnetic piece 3, the lower magnet 4 and the lower magnetic portion 2. An affixing element 7 is used to affix a circular voice coil 6 between the upper magnetic portion 1 and the lower magnetic portion 2 inside the box 5. The voice coil 6 wraps around one side of the magnetic piece 3. A truncated cone-shaped basket 8 is affixed on the voice coil 6 through glue or soldering and thus to form an affixing point 83. Diaphragm 81 and 82 is connected with the interior surface of the box 5 through a folded structure 9. When an AC current flows through the voice coil 6, a magnetic force induced by the current would move the voice coil 6 and diaphragm 81 and 82 longitudinally, thereby generating audible sounds. As illustrated in FIGS. 3 and 4, a ferrofluid 41 may be applied around the magnet 4 to allow the voice coil 6 to move or vibrate longitudinally as a current flows through the voice coil 6. Therefore, in such case, the affixing element 7 is no longer needed.

Figure 5:
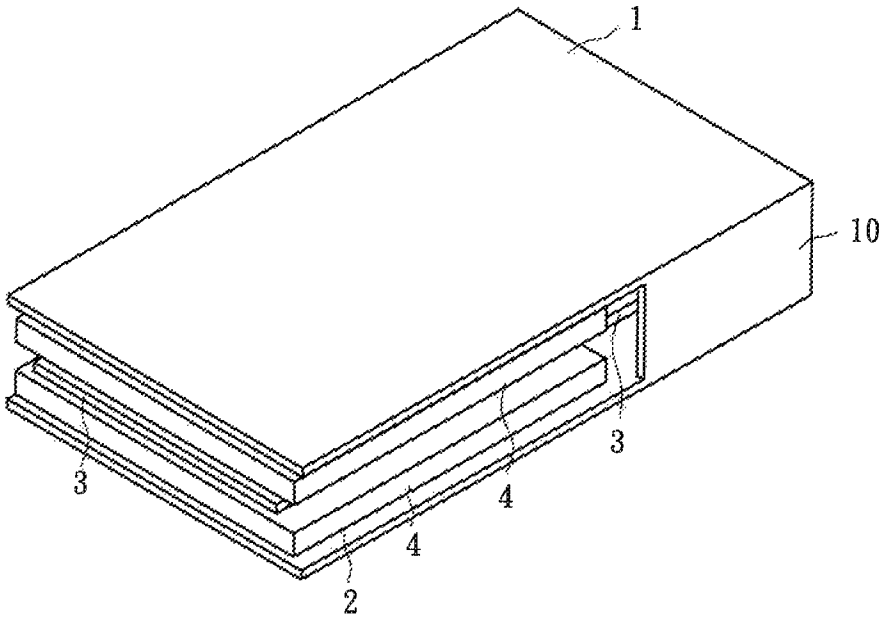
FIG. 5 is a perspective view illustrating the third embodiment of the present invention.
Figure 6:
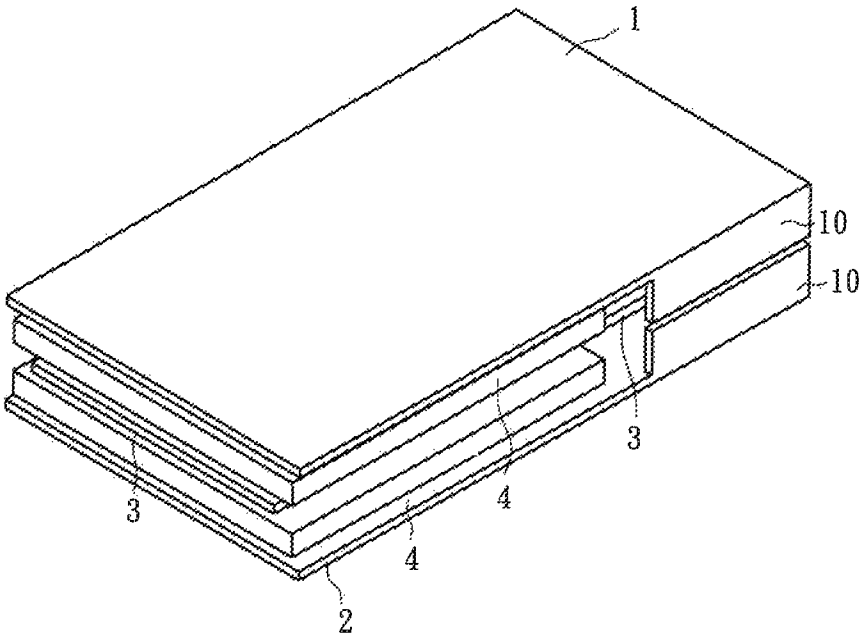
FIG. 6 is a perspective view illustrating the fourth embodiment of the present invention.

Now, please see FIGS. 5 and 6, which illustrate the third and fourth embodiments of the present invention. In FIG. 5 (the third embodiment), an extended magnetic part 10 integrally formed with the upper magnetic portion 1 and the lower magnetic portion 2 connects the upper magnetic portion 1 with the lower magnetic portion 2. In FIG. 6 (the fourth embodiment), there is a gap between an upper extended magnetic part 10 integrally formed with the upper magnetic portion 1 and a lower extended magnetic part 10 integrally formed with the lower magnetic portion 2. In either embodiment, as an AC current flow through the voice coil 6, the magnetic field of the extended magnetic part 10 can interact with the magnetic field generated by the voice coil 6.

Because speakers become thinner and thinner, the design of the present invention can make a speaker thinner than the prior art speaker and we only have to increase the length of magnets 4 to increase their volume to increase the magnetic force and hence offset the decrease in the magnetic force due to a thinner configuration.

From the above, we can see that the innovative magnetic design of the present invention meets the relevant patent requirements. It is hoped that the patent application will be approved.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A magnetic design for speakers, comprising:

an upper magnetic portion, which has the form of a plate;

a lower magnetic portion, which also has the form of a plate;

at least one magnetic piece;

two or more magnets, including an upper magnet disposed between the upper magnetic portion and the magnetic piece and a lower magnet disposed between the lower magnetic portion and the magnetic piece;

wherein either a lower surface of the upper magnet or an upper surface of the lower magnet should have the same magnetic polarity as the magnetic piece, the upper surface of the upper magnet should have the same magnetic polarity as the upper magnetic portion and the lower surface of the lower magnet should have the same magnetic polarity as the lower magnetic portion; and a voice coil surrounding the magnetic piece and located in a first gap between the upper magnetic portion and the magnetic piece and in a second gap between the lower magnetic portion and the magnetic piece;

wherein said upper magnetic portion, said lower magnetic portion, said at least one magnetic piece, said upper and lower magnets and said voice coil have longitudinal directions extending in the same direction.

2. The magnetic design as in claim 1, wherein, the lower surface of the upper magnet, the upper surface of the lower magnet and the magnetic piece are of south pole, the upper surface of the upper magnet, the lower surface of the lower magnet, the upper magnetic portion and the lower magnetic portion are of north pole.

3. The magnetic design as in claim 1, wherein, the lower surface of the upper magnet, the upper surface of the lower magnet and the magnetic piece are of north pole, the upper surface of the upper magnet, the lower surface of the lower magnet, the upper magnetic portion and the lower magnetic portion are of south pole.

4. The magnetic design as in claim 1, wherein an extended magnetic part integrally formed with the upper magnetic portion and the lower magnetic portion connects the upper magnetic portion with the lower magnetic portion.

5. The magnetic design as in claim 1, wherein there is a gap between an upper extended magnetic part integrally formed with the upper magnetic portion and a lower extended magnetic part integrally formed with the lower magnetic portion.

6. The magnetic design as in claim 1, wherein magnitude of magnetic field of the speaker is increased by increasing the length in the longitudinal direction of the magnets.

* * * * *